United States Patent [19]

A-Yan

[11] 4,426,945

[45] Jan. 24, 1984

[54] METHOD FOR MANUFACTURE OF FEATHER QUILT

[76] Inventor: Kuo A-Yan, 8-1 Fu Chung Rd., 8 Lin Yushow Lee, Panchiao, Taipei Hsien, Taiwan

[21] Appl. No.: 483,632

[22] Filed: Apr. 8, 1983

[51] Int. Cl.[3] ..... D05B 97/00; B32B 7/08

[52] U.S. Cl. ..... 112/262.1; 112/420; 112/440; 53/524

[58] Field of Search ..... 112/262.1, 440, 441, 112/404, 417, 420; 53/524

[56] References Cited

U.S. PATENT DOCUMENTS

| | | | |
|---|---|---|---|
| 1,371,755 | 3/1921 | Gilcrest | 112/420 |
| 2,749,690 | 6/1956 | Bridges et al. | 53/524 |
| 2,878,481 | 3/1959 | Siminow | 112/420 X |
| 3,199,481 | 8/1965 | Handwerker | 112/420 |
| 3,664,090 | 5/1972 | Atkin | 53/524 X |
| 4,115,610 | 9/1978 | Wortman | 112/420 X |

FOREIGN PATENT DOCUMENTS

| | | | |
|---|---|---|---|
| 1245304 | 2/1960 | Fed. Rep. of Germany | 53/524 |
| 1418267 | 10/1965 | France | 53/524 |

*Primary Examiner*—H. Hampton Hunter
*Attorney, Agent, or Firm*—Schwartz & Weinrieb

[57] ABSTRACT

A feather quilt comprising upper and lower cloth layers, a multiplicity of rectangular spaces arrayed in regular rows and files in the interspace between the upper and the lower layer, and down placed to fill up the rectangular spaces is manufactured by sewing ribbonlike partition pieces to the inner sides of the upper and lower layers along the individual boundaries of the rectangular spaces running in the longitudinal (or lateral) direction and T-shaped partition pieces to the aforementioned inner sides along the individual boundaries of the rectangular spaces running in the lateral (or longitudinal) direction, sewing together the corresponding ribbonlike partition pieces fastened to the upper and lower layers, similarly sewing the T-shaped partition pieces together with the exception of the openings formed of the projecting portions thereof, and sequentially filling with down the rectangular spaces formed between the upper and lower layers by the use of a down injection tube inserted through the openings into the interiors of the successive rectangular spaces. By this method, a feather quilt of any desired thickness can be easily and efficiently manufactured without reference to the diameter of the down injection tube used for the transfer of the down.

3 Claims, 7 Drawing Figures

METHOD FOR MANUFACTURE OF FEATHER QUILT

BACKGROUND OF THE INVENTION

This invention relates to a method for the manufacture of a feather quilt, and more particularly to a method for manufacturing a feather quilt by dividing the interspace between the upper and lower cloth layers of a quilt enclosure into rectangular spaces arranged in regular rows and files and blowing down into the rectangular spaces of the quilt enclosure.

Conventional feather quilts have been manufactured some by uniformly distributing down in the interspace between the upper and lower cloth layers of a quilt enclosure and stitching the upper and lower cloth layers together in properly spaced longitudinal and lateral lines and others by arranging hollow cubes of fabric containing down in regular rows and files in the interspace of a quilt enclosure and sewing these cubes to the quilt enclosure. The former feather quilts are easy to manufacture but cannot be expected to acquire ample thickness. Besides, their outer sides are awkward both in appearance and to touch. The latter multi-cube quilts come in numerous kinds and shapes. Regardless of the kind and shape, these quilts are difficult to manufacture. They also suffer from a disadvantage that the down contained therein cannot be completely prevented from moving about randomly within the interspaces of the quilts.

For the purpose of facilitating the manufacture of a multi-cube quilts, there has been proposed a method which comprises inserting partitions running in spaced longitudinal and lateral lines within the interspace between the upper and lower cloth layers of a quilt enclosure thereby forming rectangular spaces in the quilt enclosure and injecting down into the individual rectangular spaces via a down injection tube successively inserted into the rectangular spaces through the openings formed in advance in their respective partitions.

One version of this method has been known from the disclosure of Japanese Patent Publication Sho 56(1981)-1094. This method produces a feather quilt by the steps of disposing a plurality of lateral partitions at proper intervals in the interspace between the upper and lower cloth layers of a quilt enclosure and, at the same time, disposing longitudinal partitions at fixed intervals in the spaces separating the adjacent lateral partitions, with the intersections of the lateral and longitudinal partitions left unsewed, and injecting down into the rectangular spaces defined by the lateral and longitudinal partitions as orderly arranged in rows and files through the unsewed intersections.

Generally, the tube used for the injection of down into the rectangular spaces is required to have an inside diameter of not less than 30 mm. Otherwise, the tube is clogged with down and prevented from efficiently filling the rectangular spaces in the quilt enclosure with down. To form openings large enough to permit insertion of a down injection tube having an outside diameter of well over 30 mm (about 100 mm in circumferential length) by keeping the intersections of the partitions unsewed, the partitions are required to have a very large inner volume. Consequently, a huge volume of down is required to fill up all the rectangular spaces. Also disadvantageously, the down filling the rectangular spaces can move freely between the adjacent rectangular spaces through the large openings during the use of the quilt. Some rectangular spaces may bulge out and others shrink down in one and the same quilt. Thus, the down which has been originally distributed evenly in all the individual rectangular spaces will gather densely at some portions and disperse thinly at other portions. Moreover, the work of sewing the longitudinal partitions and the lateral partitions on one edge to the upper layer and on the other edge to the lower layer respectively of the quilt enclosure takes much time and labor.

To overcome the disadvantages suffered by the conventional method, the present inventor has proposed in Japanese Utility Model Application Sho 56(1981)-130619 a feather quilt manufactured by arranging, in rows and files, unit bags each having the shape of a cube and incorporating a tubular opening in either or both of the longitudinal sides thereof and injecting down into the unit bags via a down injection tube similar to the tube mentioned above, successively into the tubular openings of the unit bags. In accordance with this method, the thickness of the unit bags can be fixed without reference to the diameter of the down injection tube and the quilt can be finished in a suitable thickness. This method nevertheless has a disadvantage that the work of preparing the individual unit bags consumes much time and labor.

SUMMARY OF THE INVENTION

An object of this invention is to provide a method for the manufacture of a feather quilt which permits rectangular spaces to be easily formed in regular rows and files in the interspace between the upper and lower cloth layers of a quilt enclosure, enables down to be readily injected into the rectangular spaces, prevents down from randomly moving between the adjacent rectangular spaces, and permits the quilt to be finished in a thickness fixed without reference to the diameter of a down injection tube to be used.

To accomplish the object described above according to this invention, there is provided a method for the manufacture of a feather quilt, which comprises the steps of:

sewing slender ribbonlike partition pieces along one edge portion thereof to the opposed sides of the boundaries defining rectangular areas on the inner sides of upper and lower layers of one equal size, sewing T-shaped partition pieces each having a slender partition portion and a projecting portion protruding from the central portion of the slender partition portion, along one edge portion thereof to the other opposed sides of the aforementioned boundaries, opposing the corresponding ribbonlike partition pieces from the upper and lower layers, sewing their remaining edge portions together, similarly opposing the corresponding T-shaped partition pieces, sewing their remaining edge portions together with the exception of the portions from which the projecting portions rise, and superposing and sewing together the extended portions of the ribbonlike partition pieces and the T-shaped portions along the intersections of the boundaries of the rectangular spaces, sewing the opposed lateral sides of the projecting portions of the T-shaped partition pieces from the upper and lower layers thereby forming openings one each at the leading ends of the projecting portions, and inserting a down injection tube successively into the openings in the T-shaped projecting portions, and blowing down through this tube into the rectangular spaces.

By allowing one down injection tube to be successively inserted into the openings formed in either a longitudinal direction or a lateral direction one each in the T-shaped projecting portions of the rectangular spaces arrayed in regular rows and files, the rectangular spaces are sequentially filled with down outwardly from the innermost row. The opening in each T-shaped projecting portion is closed as the mass of down filling the rectangular space expands by its own expansive force after the withdrawal of the down injection tube. Thus, the possibility that the down placed in the individual rectangular spaces will move about randomly between the adjacent rectangular spaces is completely precluded. Since the projected opening of a width commensurate with the circumference of the down injection tube is provided near the center of the lateral side of each rectangular space, the down injection tube having a diameter greater than the thickness of the finished quilt can be easily inserted into the rectangular space. The sewing of the partition pieces to the upper and lower layers and the mutual sewing of the partition pieces can be carried out relatively easily and the introduction of down into the individual rectangular spaces can also be effected with ease. Consequently, the manufacture of the feather quilt of this invention can be accomplished without requiring much time and labor. The down placed in the rectangular spaces is now suffered to move about randomly between the adjacent rectangular spaces. Thus, the present invention produces a feather quilt which withstands prolonged service.

The other objects and characteristic features of this invention will become apparent to those skilled in the art as the disclosure is made in the following description of a preferred embodiment of the invention, as illustrated in the accompanying drawings.

DESCRIPTION OF THE PREFERRED EMBODIMENTS

Figure 1:
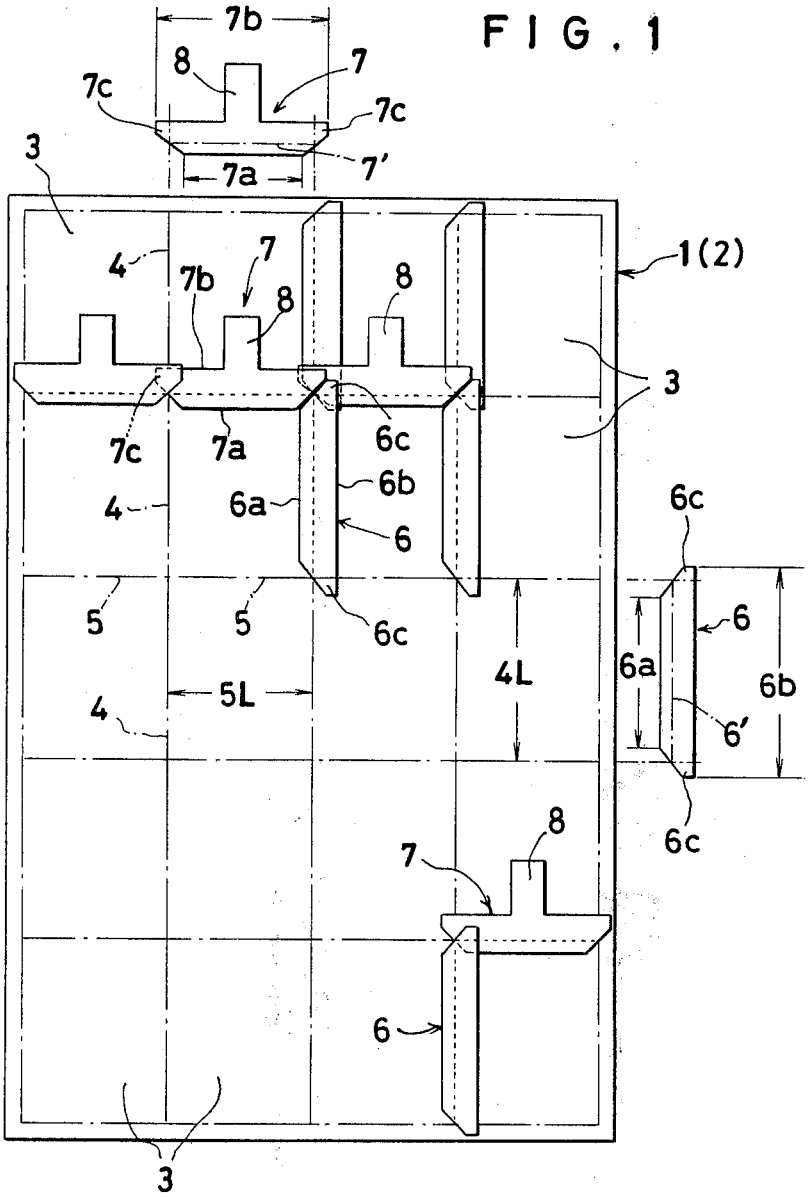
FIG. 1 is a plan view of a typical upper cloth layer of a quilt having partition pieces partly attached to the inner side thereof.

The accompanying drawings are explanatory diagrams for illustrating one embodiment of the method of this invention for the manufacture of a feather quilt. In the drawings, 1 and 2 denote rectangular upper and lower cloth layers of one equal size. In the illustrated embodiment, a total of 20 rectangular spaces 3 arranged in five files and four rows between the cloth layers. FIG. 1 illustrates the inner side of the upper layer 1, which is similar to that of the lower layer 2. To the inner sides, ribbonlike partition pieces 6 are sewed by the edge portion *6a* side to all the longitudinal boundaries of the longitudinally and laterally adjoining rectangular spaces and T-shaped partition pieces 7 are sewed by the edge portion *7a* side to all the lateral boundaries of the aforementioned rectangular spaces, both throughout the lengths of the respective boundaries. Of course, it is permissible for the T-shaped partition pieces 7 to be sewed by the edge portion *7a* side along the longitudinal boundaries 4 and the ribbonlike partition pieces 6 by the edge portion *6a* side along the lateral boundaries as will be more specifically described afterward.

The upper layer 1, the lower layer 2, and the individual partition pieces 6, 7 are made of cloth. The T-shaped partition pieces 7 comprise a ribbonlike partition portion and a projecting portion 8, either formed integrally or separately cut and subsequently joined by sewing or cementing, halfway along the edge portion *7b* of the ribbonlike partition portion opposite the edge portion *6a*.

The construction described above is not the only one that can be used. In the illustrated embodiment, the length of the edge portion *6a* of each ribbonlike partition piece 6 is slightly smaller than the length 4L of the boundary 4 and the length of the other edge portion *6b* thereof is greater than the length 4L. Thus, the ribbonlike partition piece contains at each of the opposite extremities thereof an extended portion *6c* having an oblique side and protruding from the boundary 4L. Similarly, the length of the edge portion *7a* of each T-shaped partition piece is slightly smaller than the length 5L of the boundary 5 and the length of the other edge portion *7b* containing the projecting portion 8 is greater than the length 5L. Thus, the T-shaped partition piece similarly contains at each of the opposite extremities thereof an extended portion *7c* having an oblique side and protruding from the boundary 5L. The edge portions *6a*, *7a* of the partition pieces 6, 7, therefore, are sewed to the inner sides of the upper and lower layers along the parts 6', 7' falling slightly inside from the edges and having lengths between the opposite oblique sides thereof equalling the lengths 4L, 5L of the respective boundaries. As a result, the extended portions *6c*, *7c* at the opposite extremities on the sides of the other edge portions *6b*, *7b* overlap as mutually liberated along the intersections of the boundaries.

After the ribbonlike partition pieces 6 have been fastened along the edge portion *6a* side to all the longitudinal boundaries 4 and the T-shaped partition pieces 7 along the edge portion *7a* side to all the lateral boundaries 5 on the inner sides of the upper layer 1 and the lower layer 2 as described above, the corresponding ribbonlike partition pieces 6 from the upper and lower layers are mutually sewed along their other edge portions *6b* and the corresponding T-shaped partition pieces 7 are mutually sewed along their edge portions *7b* containing a projecting portion 8 with the exception of the portions from which the projecting portions rise, to give rise to rectangular spaces as arrayed in regular rows and files between the upper and lower layers and to openings 9 for the insertion of a down injecting tube between the projecting portions 8 of the adjacent T-shaped partition pieces fastened to the upper and lower layers.

Figure 4:
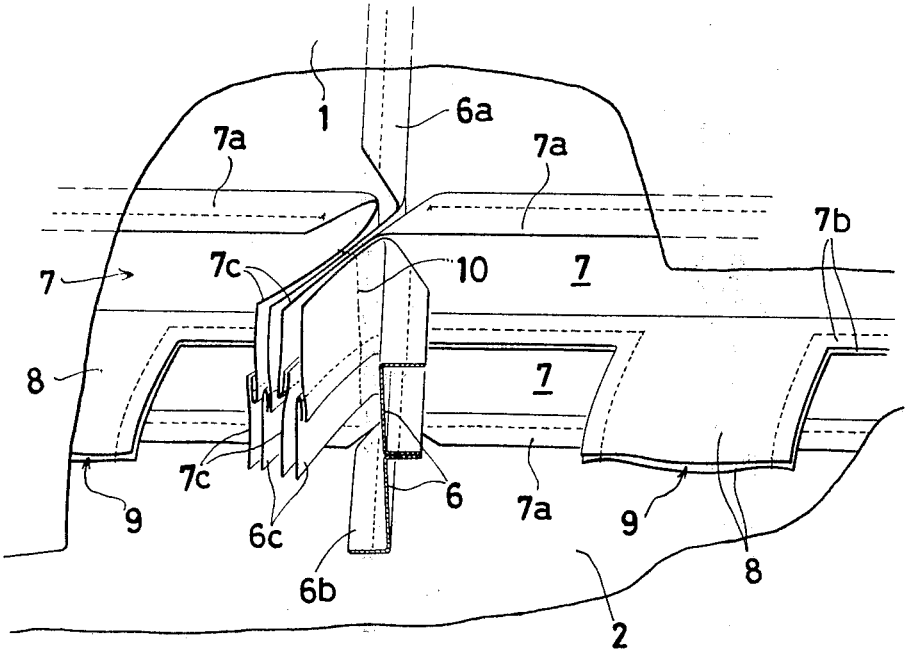
FIG. 4 is a perspective view illustrating the condition in which the aforementioned partition pieces are mutually sewed.

Then, the group of extended portions *6c* and the corresponding group of extended portions *7c* at the opposite extremities respectively of the paired ribbonlike partition pieces and the paired T-shaped partition pieces attached to the upper and lower layers so as to define in mutually perpendicularly intersecting directions the rectangular spaces arranged in regular rows and files are superposed and then sewed along the basal lines 10 of the superposed extended portions running vertically relative to the upper and lower layers to join the ribbonlike partition pieces and the T-shaped partition pieces integrally (FIG. 4). The superposed extended portions may be cut short, when necessary, along lines slightly outside the sewed lines 10.

To permit the partition pieces 6 and the partition pieces 7 attached to the upper and lower layers to be sewed together as described above, (I) the vertical partition pieces 6 attached to the upper and lower layers so as to separate vertically the individual rectangular spaces from one another in the lowermost row and the partition pieces 7 similarly attached so as to separate horizontally the rectangular spaces in the lowermost row from those in the second row from the bottom are sewed together along the edge portions *6b* and the edge portions *7b*, (II) then the partition pieces 6 separating the leftmost rectangular space and the second rectangular space from the left in the second row from the bottom are sewed together along the edge portions *6b*, and (III) subsequently the extended portions of each set of four partition pieces attached to the upper and lower layers so as to intersect one another perpendicularly are drawn out as orderly superposed into the second rectangular space from the left in the second row from the bottom and the superposed extended portions are sewed together along their basal line running vertically relative to the upper and lower layers to join the aforementioned partition pieces integrally. Thereafter, the partition pieces 6 separating the second and third rectangular spaces from the left in the second row from the bottom are sewed together along their edge portions *6b* and the extended portions of the corresponding set of four partition pieces are drawn out as orderly superposed into the third rectangular space from the left and the superposed extended portions are sewed together along their basal line running vertically relative to the upper and lower layers. By repeating this work, the rectangular spaces are completed in the second row from the bottom. Then, the partition pieces 7 separating the rectangular spaces in the second row and those in the third row respectively from the bottom are sewed together along the edge portions *7b*. Again, the partition pieces separating the first and second rectangular spaces from the left in the third row from the bottom are sewed together along their edge portions *6b* and the extended portions of these partition pieces are sewed together in an orderly superposed state. In the manner described above, all the rectangular spaces are successively formed upwardly from the bottom and rightwardly from the leftmost file. Thus, the two rightmost rectangular spaces in the uppermost row are formed finally.

Of course, the rectangular spaces may be successively formed leftwardly from the rightmost file, similarly upwardly from the bottom row. Otherwise, these rectangular spaces may be formed downwardly from the uppermost row either rightwardly or leftwardly from the left or right. Alternately, they may be formed rightwardly or leftwardly from the leftmost or rightmost file and downardly or upwardly from the uppermost or lowermost row.

In this case, when the rectangular spaces are successively formed upwardly from the lowermost row and rightwardly from the leftmost file, the left edges 1L, 2L of the upper and lower layers running parallelly to the partition pieces 6 may be joined by sewing before the partition pieces are sewed together, while the right edges 1R, 2R and the upper edges 1U, 2U running parallelly to the T-shaped partition pieces will be joined by sewing after the partition pieces are sewed together so that the free ends of the upper and lower layers may be rolled up enough for the partition pieces to be sewed together with ease. Particularly, the work of joining the edges of the upper and lower layers which run parallelly to the T-shaped partition pieces and which do not face the projecting portions 8, namely the lower edges 1B, 2B in the present embodiment, throughout the entire length thereof to close the edges will be carried out after all the rectangular spaces have been filled with down, so as to facilitate the successive insertion of the down injection tube into the opening 9.

Figure 5:
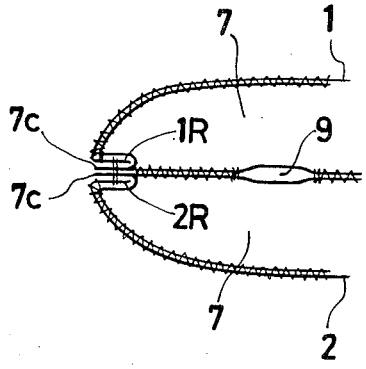
FIG. 5 is a cross section illustrating the condition in which the matched edges of the upper and lower cloth layers are sewed together.

When the left edge portions of the leftmost of all the partition pieces separating the individual rows of rectangular spaces and the right edge portions of the rightmost of all the aforementioned partition pieces and the upper edge portions of the partition pieces separating the individual rectangular spaces in the uppermost row and the lower edge portions of the partition pieces separating the individual rectangular spaces in the lowermost row are severally provided with extended portions *6c*, *7c*, such extended portions may be nipped between the paired edges 1L and 2L, 1R and 2R, 1U and 2U, and 1B and 2B respectively and sewed thereon at the time that these edges are tucked and sewed together (FIG. 5). Consequently, possible establishment of communication between the longitudinally and laterally adjacent rectangular spaces not merely in the inner part but equally in the outer part of the finished quilt may be perfectly precluded.

Figure 6:
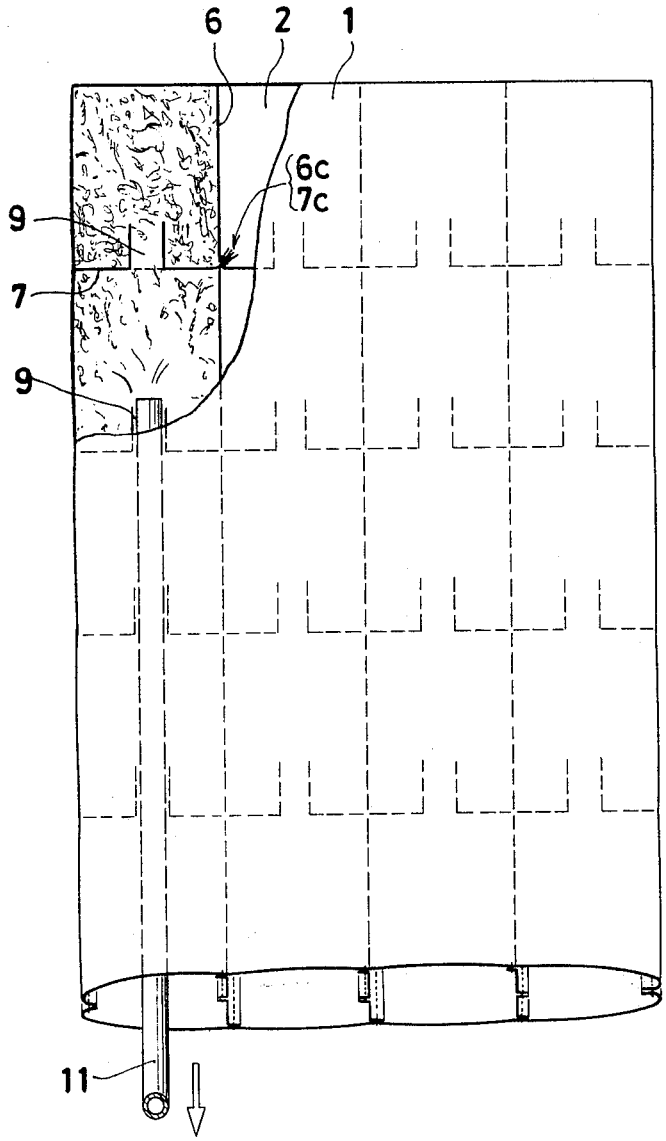
FIG. 6 is an explanatory diagram illustrating the condition in which down is injected into rectangular spaces in the quilt.

After the opposed partition pieces attached to the upper and lower layers have been sewed together and all the matched edges of the upper and lower layers excepting the lower edges have been sewed up, the down injection tube 11 is slid in through the open lower edges of the upper and lower layers and inserted through the openings formed of the projecting portions of the T-shaped partition pieces until the leading end thereof thrusts into the uppermost of the rectangular pieces in the first file. After that particular rectangular space has been filled to capacity with the down fed through the tube, the down injection tube is slightly drawn back until the leading end thereof reaches the interior of the second rectangular space from the top in the first file to supply down into this rectangular space (FIG. 6).

After the rectangular spaces in the first file have been successivley filled with the down from the uppermost row downwardly by having the down injection tube drawn back stepwise by fixed intervals along the file, the rectangular spaces in the next file are similarly filled with the down from the uppermost row downwardly. This procedure is repeated until all the rectangular spaces of the quilt are filled with the down. Optionally, for delivery to the rectangular spaces in the lowermost row, the down may be manually measured and inserted instead of being forwarded through the down injection tube. Then, after these rectangular spaces have been filled with the down, the lower edges of the upper and lower layers may be sewed together. Alternatively, the lower edges of the upper and lower layers may be sewed up with the exception of the portions left open directly opposite the rectangular spaces in the lowermost row, each in a width enough to permit insertion of the down injection tube. In this case, the down injection tube is sequentially slid in via the unsewed portions and inserted through the aforementioned openings 9, and drawn back stepwise as described above to feed the down to the rectangular spaces in the files successively from the uppermost row downwardly. After the last rectangular space in the quilt has been filled with the down, the down injection tube is completely drawn out of the quilt and the unsewed portions of the lower edges of the quilt are closed by sewing.

In the present embodiment, since the vertically adjacent rectangular spaces in a given file are allowed to communicate with one another through the openings 19 formed of the projecting portions of the T-shaped partition pieces, the down injection tube can be inserted through the rectangular spaces to supply the down into the interiors thereof as described above.

Figure 2:
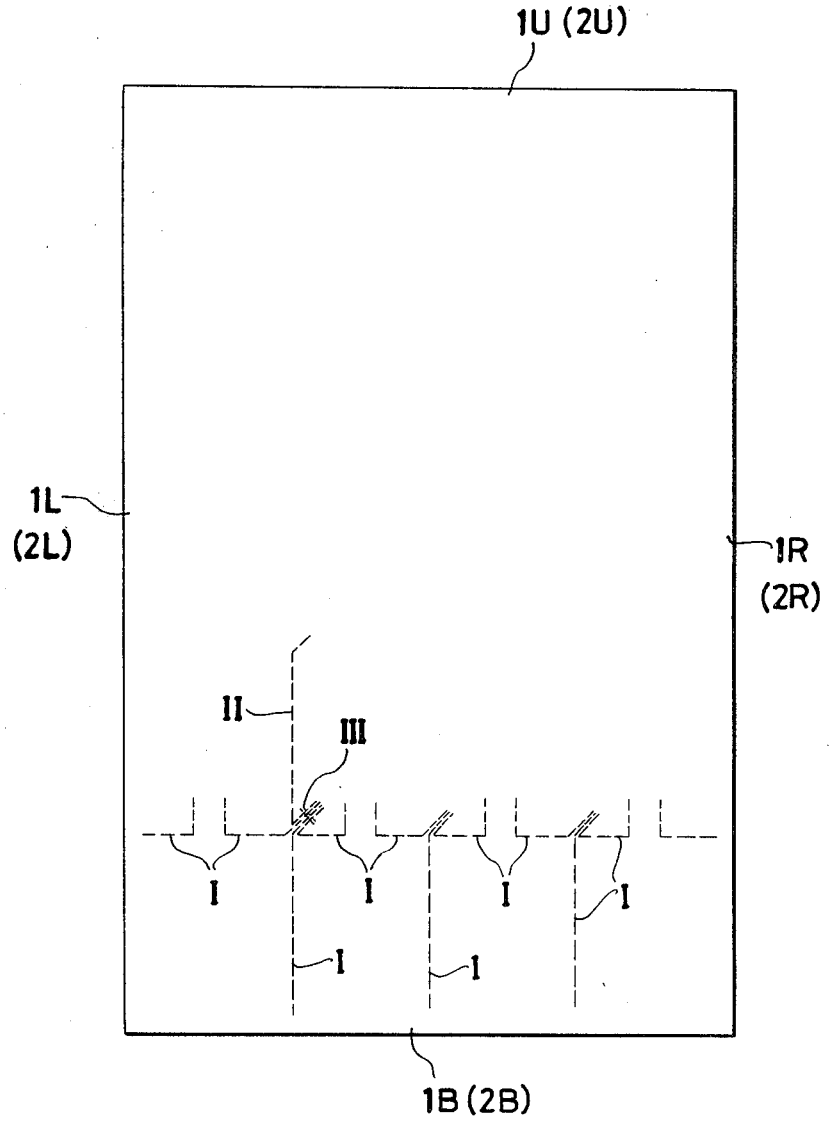
FIGS. 2 and 3 are explanatory diagrams illustrating one typical condition in which partition pieces from the upper and lower cloth layers are mutually sewed.
Figure 3:
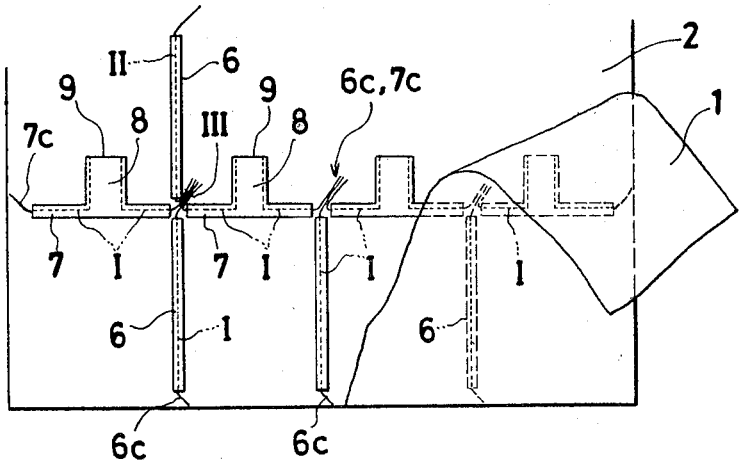
Figure 7:
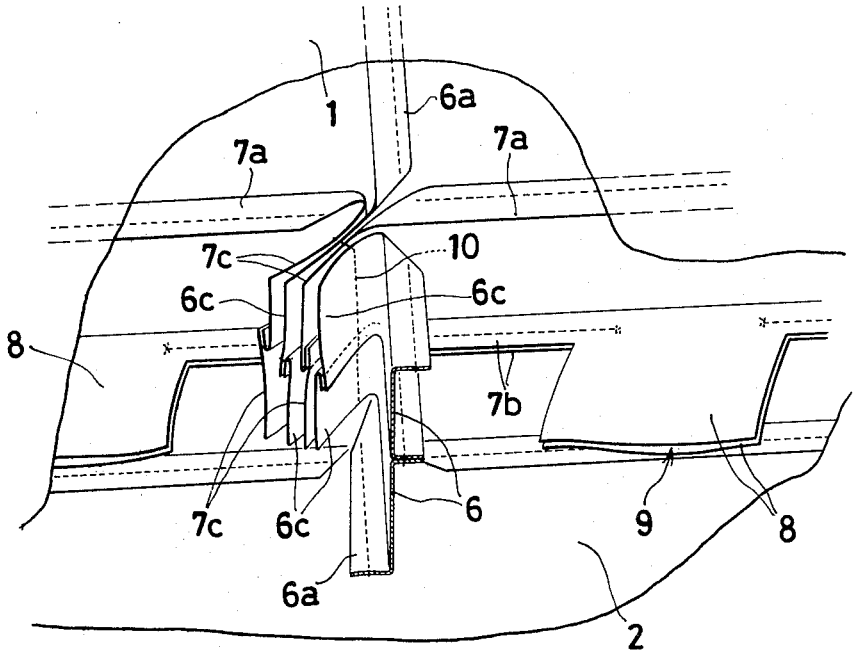
FIG. 7 is a perspective view similar to the perspective view of FIG. 4, for illustrating one modification to the condition in which openings for the passage of a down injection tube are formed.

The openings 9 are formed by sewing together the edge portions *7b* of the T-shaped partition pieces attached to the upper and lower layers, with the exception of the projecting portions 8. In this case, the statement that the edge portions are sewed together with the exception of the T-shaped projecting portions can imply two cases, one in which the opposite lateral sides of the T-shaped projecting portions are sewed as continued at right angles to the edge portions *7b*, with the leading ends only left unsewed as illustrated in FIGS. 2–4 (former case) and another in which the opposite lateral sides and the leading ends of the T-shaped projecting portions are left unsewed as illustrated in FIG. 7 (latter case). In the former case, the openings 9 are formed in a tubular shape. After a given rectangular space has been filled with the down, the opening 9 of this rectangular space flattens, bends down, and gets clogged with the down held inside the rectangular space when the down injection tube is pulled out of this opening. The opening 9 thus reduced to a crushed, clogged state perfectly prevents possible random movement of the down between the adjacent rectangular spaces. In the latter case, the openings are not formed in a tubular shape. When the down injection tube is drawn out of a given rectangular space, however, the free T-shaped projecting pieces of this rectangular space overlap and bend down and, similarly to the former case, provide prevention of the random movement of the down between the adjacent rectangular spaces. Yet, there is a possibility that the down will force its way through the lateral sides into the space embraced between the T-shaped projecting pieces. The most desirable way of forming the openings, therefore, is by joining the opposite lateral sides by sewing as in the former case. Generally, for the projecting portions 8 to fulfill their function advantageously, they are required to have a width of about 7 to 12 cm and a height of about 5 to 12 cm.

In the illustrated embodiment, the T-shaped partition pieces 7 are sewed to the upper and lower layers along the lateral boundaries of rectangular spaces. As already described, the present invention can be equally embodied by having the T-shaped partition pieces sewed along the longitudinal boundaries of rectangular spaces and the ribbonlike partition pieces 6 similarly along the lateral boundaries thereof. In this case, the finishing of the quilt may be accomplished by inserting the down injection tube through the rectangular spaces in one row until the leading end thereof reaches the farthest of such rectangular spaces, blowing the down into the farthest rectangular space through the tube until the space is filled to capacity, then drawing the tube back stepwise by fixed intervals to move the leading end of the tube from one to the next rectangular space in the row while keeping continual supply of the down to the successive rectangular spaces in the row, and repeating the reciprocating travel of the down injection tube through the rectangular spaces sequentially in all the remaining rows.

When the down injection tube is inserted through the rectangular spaces in a file or when it is inserted through the rectangular spaces in a row, the insertion should be made in the direction from the basal portion to the leading end of the T-shaped projecting portion of each of the successive rectangular spaces and never in the opposite direction, so as to ensure easy passage of the tube through the openings concealed within the rectangular spaces.

In accordance with this invention, the rectangular spaces arrayed in regular rows and files can be easily formed in the interspace between the upper and lower cloth layers of a quilt enclosure by attaching ribbonlike partition pieces to the upper and lower layers along the boundaries of such rectangular spaces running in one of the two perpendicularly intersecting directions and the T-shaped partition pieces similarly along the boundaries thereof running in the other direction and sewing the corresponding ribbonlike partition pieces and the corresponding T-shaped partition pieces together while keeping the upper and lower layers rolled up. Further, the T-shaped partition pieces serve to provide no-return type openings which permit ready insertion of the down injection tube for supply of the down to the interiors of the rectangular spaces and which prevent the down already placed in the rectangular spaces from randomly moving about between adjacent rectangular spaces.

What is claimed is:

1. A method for the manufacture of a feather quilt by the steps of attaching partition pieces to the upper and lower cloth layers of an equal size of a quilt enclosure along longitudinally and laterally spaced lines thereby forming rectangular spaces arrayed in regular rows and files in the interspace between said upper and lower cloth layers of the quilt enclosure and blowing down into said rectangular spaces, which method comprises:

sewing ribbonlike partition pieces by one edge portion thereof to the inner sides of said upper and lower layers along all the boundaries of said rectangular spaces running in either of the two perpendicularly intersecting directions and sewing T-shaped partition pieces, which comprise a partition portion and a projecting portion protruding in one direction from the central portion of said partition portion, by one edge portion of said partition portion to said inner sides along all the boundaries of said rectangular spaces running in the other of said intersecting directions, sewing the corresponding ribbonlike partition pieces of the upper and lower layers together along the other edge portion thereof and, at the same time, sewing the corresponding T-shaped partition pieces of the upper and lower layers together along the other edge portion of said partition portion except for the portion from which said T-shaped projecting portion protrudes, superposing the end portions of said ribbonlike partition pieces and said T-shaped partition pieces both fastened to the upper and lower layers, and sewing the superposed end portions together, superposing said T-shaped partition pieces fastened to said upper and lower layers and sewing the opposite lateral sides of said projecting portions of said T-shaped partition pieces thereby forming openings along the edges of said projecting portions, and inserting a down injection tube through said openings formed of said T-shaped projecting portions in lateral sides of said rectangular spaces and blowing the down sequentially into the interiors of said rectangular spaces.

2. A method according to claim 1, wherein said ribbonlike partition pieces have a length slightly greater than the length of the corresponding unit boundaries running in one of the two perpendicularly intersecting directions on the inner sides of said upper and lower layers and said T-shaped partition pieces have a length slightly greater than the length of the corresponding unit boundaries running in the other of said intersecting directions on said inner sides.

3. A method according to claim 1, wherein said ribbonlike partition pieces and said T-shaped partition pieces are greater in one edge portion thereof and longer in the other edge portion thereof than the respective unit boundaries to which said partition pieces are sewed.

* * * * *

UNITED STATES PATENT AND TRADEMARK OFFICE

CERTIFICATE OF CORRECTION

PATENT NO. : 4,426,945

DATED : January 24, 1984

INVENTOR(S) : Kuo A-yan

It is certified that error appears in the above-identified patent and that said Letters Patent is hereby corrected as shown below:

Column 10, line 15, "longer" should read -- shorter --.

Signed and Sealed this

*Twenty-second* Day of *May 1984*

[SEAL]

*Attest:*

GERALD J. MOSSINGHOFF

*Attesting Officer*

*Commissioner of Patents and Trademarks*